US009093743B2

(12) United States Patent
Lan

(10) Patent No.: US 9,093,743 B2
(45) Date of Patent: Jul. 28, 2015

(54) METHOD FOR IMPLEMENTING WIRELESS EQUIPMENT ANTENNA AND WIRELESS EQUIPMENT

(75) Inventor: Yao Lan, Shenzhen (CN)

(73) Assignee: HUAWEI DEVICE CO., LTD., Shenzhen (CN)

( * ) Notice: Subject to any disclaimer, the term of this patent is extended or adjusted under 35 U.S.C. 154(b) by 619 days.

(21) Appl. No.: 13/459,737

(22) Filed: Apr. 30, 2012

(65) Prior Publication Data

US 2012/0212390 A1 Aug. 23, 2012

Related U.S. Application Data

(63) Continuation of application No. PCT/CN2010/075851, filed on Aug. 10, 2010.

(30) Foreign Application Priority Data

Oct. 30, 2009 (CN) ..... 2009 1 0207792

(51) Int. Cl.
*H01Q 1/22* (2006.01)

(52) U.S. Cl.
CPC ..... *H01Q 1/22* (2013.01)

(58) Field of Classification Search
CPC ..... H01Q 1/22; H01Q 1/50
USPC ..... 343/702, 850, 860, 725, 729, 906
See application file for complete search history.

(56) References Cited

U.S. PATENT DOCUMENTS

| | | | | |
|---|---|---|---|---|
| 6,337,666 | B1 * | 1/2002 | Bishop | 343/795 |
| 6,545,643 | B1 * | 4/2003 | Sward et al. | 343/702 |
| 6,816,121 | B1 * | 11/2004 | Cheng et al. | 343/702 |
| 7,764,236 | B2 * | 7/2010 | Hill et al. | 343/702 |

(Continued)

FOREIGN PATENT DOCUMENTS

| | | | |
|---|---|---|---|
| CN | 2929831 | Y | 8/2007 |
| CN | 101540433 | A | 9/2009 |

(Continued)

OTHER PUBLICATIONS

Written Opinion of the International Searching Authority issued in corresponding PCT Patent Application No. PCT/CN2010/075851, mailed Nov. 18, 2010.

(Continued)

*Primary Examiner* — Dameon E Levi
*Assistant Examiner* — Hasan Islam
(74) *Attorney, Agent, or Firm* — Brinks Gilson & Lione

(57) ABSTRACT

A method for implementing a wireless equipment antenna and wireless equipment are provided. The method includes: dividing the wireless equipment into a first part and a second part, and electrically connecting the two parts only through a radio frequency signal feed line and a frequency selection network component; the first part at least includes a radio frequency chip, the second part includes a connection component for connecting network equipment, and the part which is on the wireless equipment and shares the metal ground with the network equipment after connecting the network equipment except the radio frequency signal feed line and the frequency selection network component; applying the frequency selection network component to correspondingly connect the power line and data line respectively on the second part and the first part; using the second part as the antenna of the wireless equipment.

17 Claims, 1 Drawing Sheet

(56) References Cited

U.S. PATENT DOCUMENTS

| | | | | |
|---|---|---|---|---|
| 8,305,288 | B2 * | 11/2012 | Chen | 343/882 |
| 8,354,966 | B2 * | 1/2013 | Delmotte et al. | 343/702 |
| 2005/0161513 | A1 * | 7/2005 | Huang et al. | 235/492 |
| 2007/0001060 | A1 | 1/2007 | Mugg | |
| 2008/0106479 | A1 * | 5/2008 | Wang et al. | 343/702 |
| 2008/0117117 | A1 * | 5/2008 | Washiro | 343/850 |
| 2008/0246674 | A1 | 10/2008 | Rutfors et al. | |
| 2009/0033574 | A1 * | 2/2009 | Hung | 343/718 |

FOREIGN PATENT DOCUMENTS

| | | | |
|---|---|---|---|
| CN | 201315073 | Y | 9/2009 |
| CN | 101697378 | A | 4/2010 |
| KR | 20090004461 | U | 5/2009 |

OTHER PUBLICATIONS

Extended European Search Report issued in corresponding European Patent Application No. 10826008.4, mailed Aug. 6, 2013, 6 pages.

International Search Report issued in corresponding PCT Patent Application No. PCT/CN2010/075851, mailed Nov. 18, 2010.

Chinese Patent No. 101697378, issued on Nov. 21, 2012, granted in corresponding Chinese Patent Application No. 200910207792.9.

* cited by examiner

METHOD FOR IMPLEMENTING WIRELESS EQUIPMENT ANTENNA AND WIRELESS EQUIPMENT

CROSS-REFERENCE TO RELATED APPLICATION

This application is a continuation of International Application No. PCT/CN2010/075851, filed on Aug. 10, 2010, which claims priority to Chinese Patent Application No. 200910207792.9, filed with the Chinese Patent on Oct. 30, 2009, both of which are hereby incorporated by reference in their entireties.

FIELD OF THE INVENTION

The embodiments of the present invention relate to the field of communication, and particularly, to a method for implementing a wireless equipment antenna and wireless equipment.

BACKGROUND OF THE INVENTION

With the continuous development of the wireless communication technique, the data card, i.e., the wireless network card is widely used as wireless communication equipment. The data card may include a Universal Serial Bus (Universal Serial Bus, USB) interface, which is connected to the USB connectors of the equipments such as portable computer, desktop computer and gateway, so that those equipments can access the wireless Internet through the data card.

The antenna is an indispensable component of the data card, and the data card receives and transmits wireless signals through the antenna. The existing data cards widely use antennas such as monopole, inverted F antenna (IFA) and planar inverted F antenna (PIFA). The antennas are either mounted on the data card as an individual unit, or printed on the main board of the data card, so as to irradiate radio frequency signals to the outside or receive radio frequency signals transmitted from external equipments.

During the implementation of the present invention, the inventor finds that the prior art at least has the following problem: since the size of the data card is continuously reduced, the antennas provided on the data card still require independent antenna elements, and the space utilization ratio of the data card needs to be improved.

SUMMARY OF THE INVENTION

The embodiments of the present invention provide a method for implementing a wireless equipment antenna and a wireless equipment, so as to solve the problem that the space utilization ratio is not high due to the independent existence of antennas in the wireless equipment such as the data card in the prior art.

The embodiments of the present invention provide a method for implementing a wireless equipment antenna, comprising:

dividing the wireless equipment into a first part and a second part based on electrical performance, and electrically connecting the two parts only through a radio frequency signal feed line which is used as an antenna feed line and a frequency selection network component, wherein the first part at least comprises a radio frequency chip, the second part comprises a connection component used for connecting network equipment, and a part which is on the wireless equipment and shares the metal ground with the network equipment after connecting the network equipment except the radio frequency signal feed line and the frequency selection network component, the frequency selection network component exhibits a high impedance within the working frequency band of the wireless equipment, and exhibits a low impedance at direct current and the clock frequency of a digital signal on the data line;

applying the frequency selection network component to correspondingly connect a power line and a data line on the second part with a power line and a data line on the first part, respectively, and a radio frequency signal is fed from the first part to the second part through the radio frequency signal feed line; and using the second part of the wireless equipment as an antenna of the wireless equipment to receive and transmit signal.

Correspondingly, the embodiments of the present invention provide a wireless equipment, comprising: a first part, a second part, and a radio frequency signal feed line and a frequency selection network component which electrically connect the first and second parts; wherein the frequency selection network component exhibits a high impedance within the working frequency band of the wireless equipment, and exhibits a low impedance at direct current and the clock frequency of a digital signal on the data line; wherein the first part at least comprises a radio frequency chip, the second part comprises a connection component used for connecting network equipment, and a part which is on the wireless equipment and shares the metal ground with the network equipment after connecting the network equipment, except the radio frequency signal feed line and the frequency selection network component; wherein the frequency selection network component exhibits a high impedance within the working frequency band of the wireless equipment, and exhibits a low impedance at direct current and the clock frequency of the digital signal on the data line; wherein the power line and the data line on the second part are correspondingly connected to the power line and the data line on the first part, respectively, through the frequency selection network component; wherein the radio frequency signal is fed from the first part to the second part through the radio frequency signal feed line; and wherein the second part of the wireless equipment serves as an antenna of the wireless equipment.

In the above embodiments of the present invention, since the first and second parts of the wireless equipment are electrically connected to each other only through the radio frequency signal feed line and the frequency selection network component, a high impedance is exhibited between the first and second parts of the wireless equipment within the working frequency band of the wireless equipment, thereby achieving an open-circuited effect for the radio frequency signal within the working frequency band. The second part is equivalent to a metal body independent from the first part, and when the radio frequency signal is fed from the first part to the second part through the radio frequency signal feed line, the second part of the wireless equipment can serve as an antenna of the wireless equipment to receive or transmit signal. The wireless equipment no longer needs any independent antenna element, and only requires a very small space to be reserved on the wireless equipment, thus the space use efficiency of the wireless equipment is improved.

BRIEF DESCRIPTION OF THE DRAWINGS

In order to more clearly describe the technical solutions of the embodiments of the present invention, the drawings to be used in the descriptions of the embodiments are briefly introduced as follows. Obviously, the following drawings just illustrate some embodiments of the present invention, and a person skilled in the art can obtain other drawings from these drawings without paying any creative effort.

DETAILED DESCRIPTION OF THE PREFERRED EMBODIMENTS

The technical solutions of the embodiments of the present invention will be clearly and completely described as follows with reference to the drawings. Obviously, those described herein are just a part of the embodiments of the present invention, rather than all the embodiments. Based on the embodiments of the present invention, any other embodiment obtained by a person skilled in the art without paying any creative effort shall fall within the protection scope of the present invention.

Figure 1:
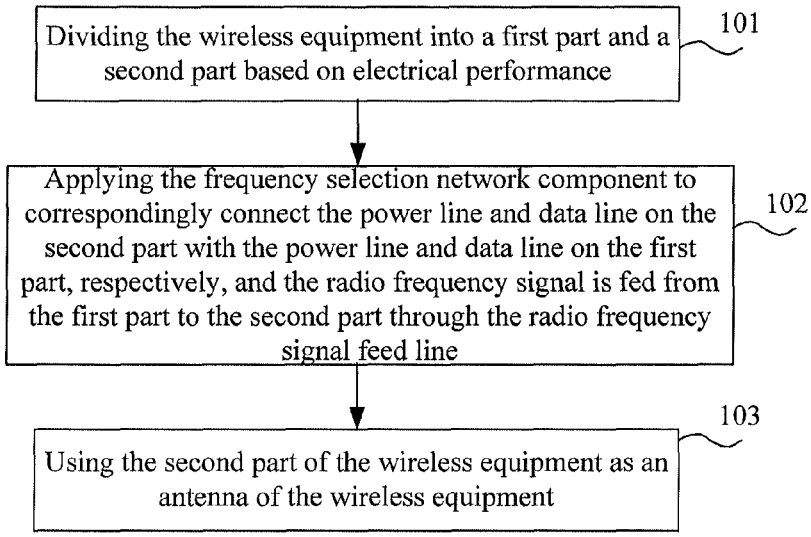
FIG. 1 is a flowchart of a method for implementing a wireless equipment antenna according to an embodiment of the present invention.

FIG. 1 is a flowchart of a method for implementing a wireless equipment antenna according to an embodiment of the present invention. As illustrated in FIG. 1, the method according to the embodiment may include:

Step 101: dividing the wireless equipment into a first part and a second part based on electrical performance.

The first part at least includes a radio frequency chip. The second part includes a connection component used for connecting a network equipment, and a part which is on the wireless equipment and shares the metal ground with the network equipment after connecting the network equipment, except a radio frequency signal feed line and a frequency selection network component. The frequency selection network component exhibits a high impedance in the working frequency band of the wireless equipment, and exhibits a low impedance at the direct current and the clock frequency of the digital signal on the data line. Herein "shares the metal ground with the network equipment" means sharing the ground with the bulk metal in the network equipment.

This embodiment gives an example in which the wireless equipment is a data card, but the wireless equipment is not limited to the data card, and it may also be other wireless equipment such as the wireless network card.

This embodiment may use the frequency selection network component and the radio frequency signal feed line that serves as the antenna feed line to divide the data card into a first part and a second part based on electrical performance. Since the frequency selection network component exhibits a high impedance in the working frequency band of the data card, and exhibits a low impedance at the direct current and the clock frequency of the digital signal on the data line, the first and second parts of the data card are disconnected for the working frequency band of the data card, i.e., the working frequency of the radio frequency signal, while connected for the clock frequency of the low-frequency digital signal and the direct current signal of the power supply, thus the first and second parts of the data card are open-circuited for radio frequency signal.

Step 102: applying the frequency selection network component to correspondingly connect the power line and data line on the second part with the power line and data line on the first part, respectively, and the radio frequency signal is fed from the first part to the second part through the radio frequency signal feed line.

Specifically, for example in the data card, the first part may include a radio frequency chip having a radio frequency module of the data card and any necessary functional module such as a base band module. The data line may include a data line D+ and a data line D−. The power line may include a power positive line and a power ground line, wherein the power ground line shares the ground with the second part, the power ground line on the first part shares the ground with the metal ground of the first part, and the power ground line on the second part shares the ground with the metal ground of the second part. Thus in the embodiment, there may be four frequency selection network components for correspondingly connecting the data line D+, the data line D−, the power positive line and the power ground line on the second part with the data line D+, the data line D−, the power positive line and the power ground line on the first part, respectively. The radio frequency signal is fed from the first part to the second part through the radio frequency signal feed line, so as to receive and transmit signal. In this embodiment, the second part of the data card may further include a connection component such as USB connector, through which the data card connects the network equipment. The USB connector also includes a metal part that shares the metal ground with the network equipment.

In this embodiment, in order to make the first radio-frequency open-circuited with second parts of the data card, the first and second parts of the data card have no metal connection except the aforementioned frequency selection network component and the radio frequency signal feed line.

Step 103: using the second part of the wireless equipment as the antenna of the wireless equipment.

Specifically, since the data card of the embodiment has the above structure, when it is being used, it can be connected to the network equipment through the connection component such as the USB connector on the second part, thus the second part of the data card can be used as the antenna of the data card to receive and transmit signal.

Assuming that in practical application, the working frequency band of the antenna is 700 MHz to 3 GHz, i.e., the working frequency of the data card is 700 MHz to 3 GHz. Since the frequency selection network component has the characteristic of passing low frequency and cutting off high frequency, the radio frequency signal to be transmitted will not be short-circuited by the data line or the power line when the radio frequency signal is fed from the first part to the second part through the radio frequency signal feed line after an antenna matching, because the frequency selection network component stops the high frequency signal. With respect to the first part, the second part of the data card and the metal ground of the network equipment to which the data card is connected may serve as an antenna to transmit the radio frequency signal. Meanwhile, due to the reciprocity principle of the antenna, the second part and the metal ground of the network equipment to which the data card is connected may also serve as an antenna to receive the wireless signal from the space. Since the clock frequency of the digital signal transmitted on the data line and the power signal transmitted on the power line are both low frequency or direct current signals, the frequency selection network component may allow the pass of the digital signal and the power signal, thus a conductive path is still formed in the data card for the low frequency signal or the DC signal, so as to ensure the normal operation of the data card.

To be noted, the working frequency of the data card in this embodiment is not limited to the above frequency range, and can be adjusted by a person skilled in the art upon the requirement.

The network equipment in this embodiment may include any communication equipment that requires the wireless network service, such as a notebook computer, a desktop computer, a gateway, etc.

In this embodiment, the frequency selection network component may either be a separate inductor, or construct the frequency selection network with inductor, capacitor, magnetic bead or common mode inductor. A person skilled in the art may appreciate that the frequency selection network component is not limited to the above four types, and may be any component having the characteristic of passing low frequency and cutting off high frequency.

Since the first and second parts of the wireless equipment are electrically connected to each other only through the radio frequency signal feed line and the frequency selection network component, the first and second parts of the wireless equipment are radio-frequency open-circuited, thus the second part of the wireless equipment can serve as an antenna of the wireless equipment to transmit a radio frequency signal when the radio frequency signal is fed from the first part to the second part through the radio frequency signal feed line. Meanwhile, due to the reciprocity principle of the antenna, the second part may also serve as an antenna to receive the radio signal from the space. The wireless equipment no longer needs any independent antenna element, and only requires a very small space to be reserved on the main board of the wireless equipment, thus improving the space use efficiency of the wireless equipment.

According to another embodiment of the method for implementing a wireless equipment antenna, the method may further include: using the second part and the metal ground of the network equipment to which the wireless equipment is connected as the antenna of the wireless equipment.

In this embodiment, the network equipment generally has a size larger than the wireless equipment (e.g., the data card), and the metal ground has an area almost as the same size as the network equipment, thus the second part may share the ground with the metal in the network equipment after the wireless equipment is connected to the network equipment. Therefore, this embodiment may not only use the second part of the wireless equipment as an antenna, but also take the metal ground in the network equipment as an antenna. In that case, the antenna area is very large, so as to produce resonant radiation energy at multiple frequency points, thereby forming an ultra-wideband antenna to support a wide operation bandwidth.

The wireless equipment according to an embodiment of the present invention may include: a first part, a second part, and a radio frequency signal feed line and a frequency selection network component which electrically connect the first and second parts; the frequency selection network component exhibits a high impedance within the working frequency band of the wireless equipment, and exhibits a low impedance at the direct current and the clock frequency of the digital signal on the data line; the first part at least includes a radio frequency chip, the second part includes a connection component used for connecting network equipment, and a part which shares the metal ground with the network equipment after connecting the network equipment except for the radio frequency signal feed line and the frequency selection network component on the wireless equipment; the frequency selection network component exhibits a high impedance within the working frequency band of the wireless equipment, and exhibits a low impedance at the direct current and the clock frequency of the digital signal on the data line; the power line and the data line on the second part are correspondingly connected to the power line and the data line on the first part, respectively, through the frequency selection network component; the radio frequency signal is fed from the first part to the second part through the radio frequency signal feed line; and the second part of the wireless equipment serves as an antenna of the wireless equipment.

In this embodiment, since the first and second parts of the wireless equipment are electrically connected to each other only through the radio frequency signal feed line and the frequency selection network component, the first and second parts of the wireless equipment are radio-frequency open-circuited, thus the second part of the wireless equipment can serve as an antenna of the wireless equipment to transmit a radio frequency signal when the radio frequency signal is fed from the first part to the second part through the radio frequency signal feed line. Further, due to the reciprocity principle of the antenna, the second part may also serve as an antenna to receive the radio signal from free space. The wireless equipment no longer needs any independent antenna element, and only requires a very small space to be reserved on the main board of the wireless equipment, thus improving the space use efficiency of the wireless equipment.

According to another embodiment of the wireless equipment of the present invention, the second part together with the metal ground of the network equipment serves as the antenna of the wireless equipment. The network equipment generally has a size larger than the wireless equipment (e.g., the data card), and the metal ground has an area almost as the same size as the network equipment, thus the second part may share the ground with the metal in the network equipment after the wireless equipment is connected to the network equipment. Therefore, this embodiment may not only use the second part of the wireless equipment as an antenna, but also take the metal ground in the network equipment as an antenna. In that case, the antenna area is very large, so as to produce resonant radiation energy at multiple frequency points, thereby forming an ultra-wideband antenna to support a wide operation bandwidth.

The following embodiment gives an example in which the wireless equipment is a data card, but the wireless equipment is not limited to the data card, and it may also be other wireless equipment such as the wireless network card.

Figure 2:
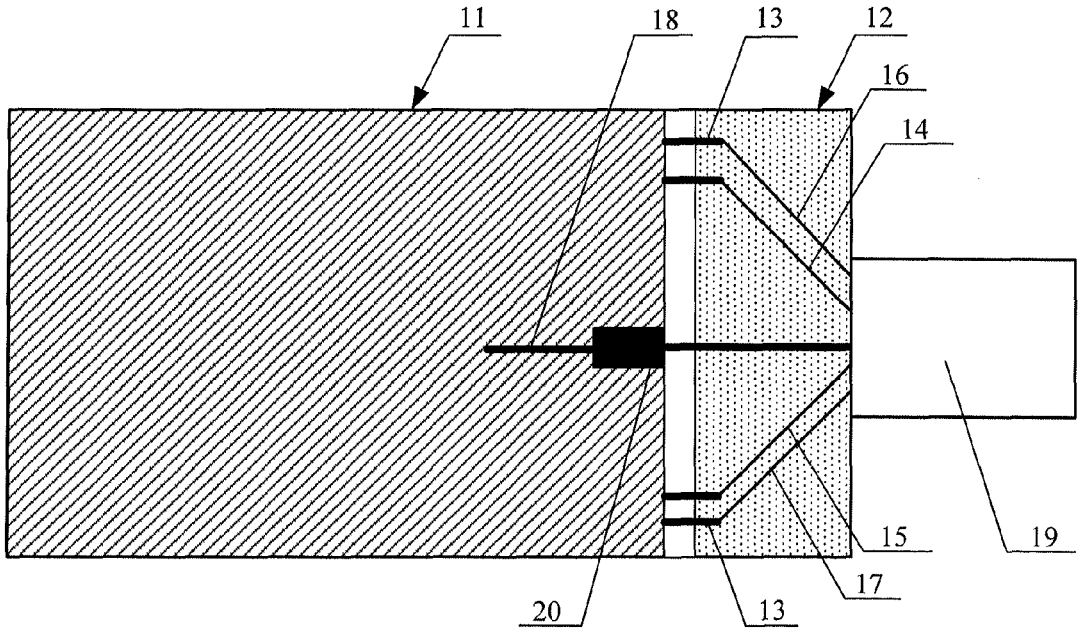
FIG. 2 is a structural diagram of wireless equipment according to an embodiment the present invention.

FIG. 2 is a structural diagram of wireless equipment according to an embodiment the present invention. As illustrated in FIG. 2, the wireless equipment (such as a data card) according to the embodiment may include: a first part 11, a second part 12 and four frequency selection network components 13. The first part 11 may include a radio frequency chip of the data card, such as base band and radio frequency component. The second part 12 may include a part which shares the metal ground with the network equipment after connecting the network equipment, on the data card, except the first part 11, the frequency selection network component and the radio frequency signal feed line. The data lines in the data card may include a data line D+ 14 and a data line D− 15. The power lines may include a power positive line 16 and a power ground line 17. The four frequency selection network components 13 correspondingly connect the data line D+ 14, the data line D− 15, the power positive line 16 and the power ground line 17 with the data lines and the power lines on the first part 11, respectively. The radio frequency signal is fed from the first part 11 to the second part 12 through the radio frequency signal feed line 18 and an antenna matching 20. Meanwhile, due to the reciprocity principle of the antenna, the second part 12 may also serve as an antenna to receive the radio signal from free space. In this embodiment, the second part of the data card may further include a USB connector 19, through which the data card connects the network equipment.

The first part 11 and the second part 12 of the data card have no metal connection other than the arrangement above.

During usage, after the data card of the embodiment is connected to the network equipment through the USB connector, the second part 12 of the data card and the metal ground of the network equipment may serve as the antenna of the data card to receive and send radio frequency signal transmitted on the radio frequency signal feed line 18.

Specifically, assuming that in practical application, the working frequency band of the antenna is 700 MHz to 3 GHz, i.e., the working frequency of the radio frequency signal feed line is 700 MHz to 3 GHz. Since the frequency selection network component 13 has the characteristic of passing low frequency and cutting off high frequency, when the radio frequency signal is fed from the first part 11 to the second part 12 through the radio frequency signal feed line 18 and an antenna matching 20, with respect to the first part, the second part of the data card and the metal ground of the network equipment to which the data card is connected, may serve as an antenna to transmit the radio frequency signal, because the frequency selection network component 13 stops the high frequency signal, and the radio frequency signal transmitted on the radio frequency signal feed line 18 will not be short-circuited by the data line D+ 14, the data line D− 15, the power positive line 16 or the power ground line 17. Meanwhile, due to the reciprocity principle of the antenna, the second part may also serve as an antenna to receive the radio signal from free space. Since either of the clock frequency of the digital signal transmitted on the data line D+ 14 and the data line D− 15 and the frequency of the power signal transmitted on the power line (i.e. the positive line 16 and the power ground line 17) is low frequency or DC signal, the frequency selection network component 13 may allow passing the digital signal and the power signal, thus a conductive path is still formed in the data card for the low frequency signal or the DC signal, so as to ensure the normal operation of the data card.

To be noted, the working frequency of the data card in this embodiment is not limited to the above frequency range, and can be adjusted by a person skilled in the art upon the requirement.

The network equipment in this embodiment may include any communication equipment that requires the wireless network service, such as a notebook computer, a desktop computer, a gateway, etc.

In this embodiment, the frequency selection network component may either be a separate inductor, or a frequency selection network constructed with inductor, capacitor, magnetic bead or common mode inductor. A person skilled in the art will be appreciated that the frequency selection network or component is not limited to the above four types, and may be any component or network having the characteristic of passing low frequency and cutting off high frequency.

In this embodiment, the network equipment generally has a size larger than the data card, and the metal ground has an area almost the same size as the network equipment, thus the second part may share the ground with the metal in the network equipment after the data card is connected to the network equipment. Therefore, this embodiment may not only use the second part of the data card as an antenna, but also take the metal ground in the network equipment as an antenna. In that case, the antenna area is very large, so as to produce resonant radiation energy at multiple frequency points, thereby forming an ultra-wideband antenna to support a wide operation bandwidth. As a result, the data card no longer needs any independent antenna element, and only requires a very small space to be reserved on the main board of the data card, thus the space use efficiency of the data card is improved.

Finally to be noted, the above embodiments are just used to describe the technical solutions of the present invention, rather than making limitations thereto. Although the present invention is detailedly described with reference to the preferred embodiments, a person skilled in the art shall be appreciated that the technical solutions of the present invention still can be amended or equivalently replaced, without deviating from the scope of the technical solutions of the present invention.

What is claimed is:

1. A method for implementing a wireless equipment antenna, by comprising:

dividing the wireless equipment into a first part and a second part based on electrical performance, and electrically connecting the two parts only through a radio frequency signal feed line which is used as an antenna feed line and a frequency selection network component, wherein the first part comprises a radio frequency chip, the second part comprises a connection component used for connecting network equipment, and a part which is on the wireless equipment and shares a metal ground with the network equipment after connecting the network equipment, wherein the part is separate from the radio frequency signal feed line and the frequency selection network component, the frequency selection network component exhibits a high impedance within the working frequency band of the wireless equipment, and exhibits a low impedance at direct current and the clock frequency of a digital signal on the data line;

applying the frequency selection network component to correspondingly connect a power line and a data line on the second part with a power line and a data line on the first part, respectively, and a radio frequency signal is fed from the first part to the second part through the radio frequency signal feed line; and using the second part of the wireless equipment as an antenna of the wireless equipment to receive and transmit signal, whereby the wireless equipment does not need an independent antenna element.

2. The method for implementing a wireless equipment antenna according to claim 1, further comprising:

using the metal ground of the network equipment connected to the wireless equipment as an antenna of the wireless equipment to receive and transmit signal.

3. The method for implementing a wireless equipment antenna according to claim 1, wherein the first part comprises the radio frequency chip of the wireless equipment.

4. The method for implementing a wireless equipment antenna according to claim 1, wherein the connection component comprises a USB connector.

5. The method for implementing a wireless equipment antenna according to claim 1, wherein the frequency selection network component comprises an inductor.

6. A wireless equipment, comprising: a first part, a second part, and a radio frequency signal feed line and a frequency selection network component which electrically connect the first and second parts; wherein the frequency selection network component exhibits a high impedance within the working frequency band of the wireless equipment, and exhibits a low impedance at direct current and the clock frequency of a digital signal on the data line; wherein the first part at least comprises a radio frequency chip, the second part comprises a connection component used for connecting network equipment, and a part which is on the wireless equipment and shares the metal ground with the network equipment after connecting the network equipment, wherein the part is separate from the radio frequency signal feed line and the frequency selection network component; wherein a power line and a data line on the second part are correspondingly connected to a power line and a data line on the first part, respectively, through the frequency selection network component; wherein the radio frequency signal is fed from the first part to the second part through the radio frequency signal feed line; and wherein the second part of the wireless equipment serves as an antenna of the wireless equipment, whereby the wireless equipment does not need an independent antenna element.

7. The wireless equipment according to claim 6, wherein the second part together with the metal ground of the network equipment serves as the antenna of the wireless equipment.

8. The wireless equipment according to claim 6, wherein the wireless equipment comprises a data card.

9. The wireless equipment according to claim 8, wherein the first part comprises the radio frequency chip of the wireless equipment.

10. The wireless equipment according to claim 8, wherein the connection component comprises a USB connector.

11. The wireless equipment according to claim 8, wherein the frequency selection network component comprises an inductor.

12. The method for implementing a wireless equipment antenna according to claim 1, where in the frequency selection network component comprises a capacitor.

13. The method for implementing a wireless equipment antenna according to claim 1, where in the frequency selection network component comprises a magnetic bead.

14. The method for implementing a wireless equipment antenna according to claim 1, where in the frequency selection network component comprises a common mode inductor.

15. The wireless equipment according to claim 8, wherein the frequency selection network component comprise capacitor.

16. The wireless equipment according to claim 8, wherein the frequency selection network component comprise a magnetic bead.

17. The wireless equipment according to claim 8, wherein the frequency selection network component comprise a common mode inductor.

* * * * *